US009552941B1

(12) United States Patent
Li et al.

(10) Patent No.: US 9,552,941 B1
(45) Date of Patent: Jan. 24, 2017

(54) VACUUM SWITCHING APPARATUS AND ELECTRICAL CONTACT THEREFOR

(71) Applicant: EATON CORPORATION, Cleveland, OH (US)

(72) Inventors: Wangpei Li, Horseheads, NY (US); Martin B. J. Leusenkamp, Suzhou (CN); Franklin Willis Freeborn, Erin, NY (US)

(73) Assignee: EATON CORPORATION, Cleveland, OH (US)

( * ) Notice: Subject to any disclaimer, the term of this patent is extended or adjusted under 35 U.S.C. 154(b) by 0 days.

(21) Appl. No.: 14/833,197

(22) Filed: Aug. 24, 2015

(51) Int. Cl.
*H01H 33/02* (2006.01)

(52) U.S. Cl.
CPC ..... *H01H 33/025* (2013.01); *H01H 2205/002* (2013.01)

(58) Field of Classification Search
CPC .. H01H 33/664; H01H 1/0203; H01H 1/0206; H01H 2205/002; H01H 33/66; H01H 11/04; H01H 11/148; H01H 1/0015; H01H 2201/0026; H01H 2009/0022; H01H 2009/005; H01H 2009/0055; H01H 2201/022
See application file for complete search history.

(56) References Cited

U.S. PATENT DOCUMENTS

| | | | | |
|---|---|---|---|---|
| 2,949,520 A | | 8/1960 | Schneider | |
| 3,089,936 A | | 5/1963 | Smith, Jr. | |
| 3,522,399 A | | 7/1970 | Crouch | |
| 3,809,836 A | * | 5/1974 | Crouch | H01H 33/6643 218/128 |
| 3,836,740 A | | 9/1974 | Hundstad | |
| 4,390,762 A | | 6/1983 | Watzke | |
| 4,445,015 A | | 4/1984 | Zueckler | |
| 4,553,002 A | | 11/1985 | Slade | |
| RE32,116 E | | 4/1986 | Griesen | |

(Continued)

FOREIGN PATENT DOCUMENTS

| | | |
|---|---|---|
| FR | 2 969 367 A1 | 6/2012 |
| JP | S57 74920 A | 5/1982 |
| JP | 2012 119254 A | 6/2012 |

OTHER PUBLICATIONS

European Patent Office, "International Search Report and Written Opinion", PCT/US2016/047449, Oct. 26, 2016, 12 pp.

*Primary Examiner* — Truc Nguyen
(74) *Attorney, Agent, or Firm* — Eckert Seamans; John Powers; Grant Coffield

(57) ABSTRACT

An electrical contact is for a vacuum switching apparatus. The vacuum switching apparatus includes a second electrical contact. The electrical contact includes a body having a center point and a periphery, the body including a plurality of arcing surfaces structured to face in a first direction toward the second electrical contact and structured to move into and out of engagement with the second electrical contact, and a plurality of arc spinning portions each defining a slot extending inwardly from the periphery generally toward the center point, the plurality of arc spinning portions generally separating the plurality of arcing surfaces from one another. At least one arc spinning portion narrows from a corresponding pair of adjacent arcing surfaces of the body to an interior thereof in a second direction opposite the first direction.

18 Claims, 8 Drawing Sheets

(56) References Cited

U.S. PATENT DOCUMENTS

| | | | | |
|---|---|---|---|---|
| 4,636,600 | A | 1/1987 | Lipperts | |
| 4,675,482 | A | 6/1987 | Bialkowski | |
| 4,717,797 | A | 1/1988 | Hoene | |
| 4,806,714 | A * | 2/1989 | Aoki | H01H 33/6643 218/129 |
| 5,444,201 | A | 8/1995 | Schulman et al. | |
| 5,804,788 | A | 9/1998 | Smith | |
| 6,080,952 | A | 6/2000 | Okutomi et al. | |
| 6,163,002 | A * | 12/2000 | Ahn | H01H 33/6643 218/123 |
| 6,541,726 | B2 * | 4/2003 | Schellekens | H01H 1/62 218/123 |
| 6,674,039 | B1 * | 1/2004 | Banghard | H01H 33/6642 218/123 |
| 7,721,428 | B2 | 5/2010 | Stoving et al. | |
| 2002/0144977 | A1 | 10/2002 | Kikuchi et al. | |
| 2003/0075528 | A1 * | 4/2003 | Nishijima | H01H 33/6642 218/123 |
| 2006/0124601 | A1 * | 6/2006 | Asmus | H01H 33/6644 218/123 |

* cited by examiner

VACUUM SWITCHING APPARATUS AND ELECTRICAL CONTACT THEREFOR

BACKGROUND

Field

The disclosed concept relates to vacuum switching apparatus such as, for example, vacuum switches including a vacuum envelope such as, for example, vacuum interrupters. The disclosed concept also pertains to electrical contacts for vacuum interrupters.

Background Information

Vacuum interrupters include separable main contacts located within an insulated and hermetically sealed vacuum chamber. The vacuum chamber typically includes, for example and without limitation, a number of sections of ceramics (e.g., without limitation, a number of tubular ceramic portions) for electrical insulation capped by a number of end members (e.g., without limitation, metal components, such as metal end plates; end caps; seal cups) to form an envelope in which a partial vacuum may be drawn. The example ceramic section is typically cylindrical; however, other suitable cross-sectional shapes may be used. Two end members are typically employed. Where there are multiple ceramic sections, an internal center shield is disposed between the example ceramic sections.

Some known vacuum interrupters include a radial magnetic field generating mechanism such as, for example and without limitation, a spiral electrical contact or a contrate cup, designed to force rotation of the arc column between the pair of electrical contacts interrupting a high current, thereby spreading the arcing duty over a relatively wide area. These vacuum interrupters suffer from a number of disadvantages. For example, as the electrical contacts experience repeated interruption of relatively high fault currents, the individual petals of the electrical contact begin to "bridge." More specifically, the individual petals of the electrical contact begin their life spaced apart from each other by slots that force the arc column to spread over the contact. As the electrical contact experiences repeated interruption of relatively high fault currents, the heavy columnar arcing causes the metal of the electrical contact to melt such that the spacing between the petals decreases, and is eventually bridged. As a result, the bridged electrical contact is prevented from allowing the arcing duty to spread over a relatively wide area. Thus, the bridged electrical contact results in the arcing being localized in the center of the electrical contact. This undesirably shortens the life of the electrical contact due to the inability to adequately interrupt the relatively high fault currents.

There is thus room for improvement in vacuum switching apparatus and in electrical contacts therefor.

SUMMARY

These needs and others are met by embodiments of the disclosed concept, which are directed to a vacuum switching apparatus and electrical contact therefor in which at least one arc spinning portion of the electrical contact narrows from a corresponding pair of adjacent arcing surfaces of the electrical contact to an interior thereof in a direction opposite an opposing electrical contact.

In accordance with one aspect of the disclosed concept, an electrical contact for a vacuum switching apparatus is provided. The vacuum switching apparatus includes a second electrical contact. The electrical contact comprises: a body having a center point and a periphery, the body comprising: a plurality of arcing surfaces structured to face in a first direction toward the second electrical contact and structured to move into and out of engagement with the second electrical contact, and a plurality of arc spinning portions each defining a slot extending inwardly from the periphery generally toward the center point, the plurality of arc spinning portions generally separating the plurality of arcing surfaces from one another. At least one arc spinning portion narrows from a corresponding pair of adjacent arcing surfaces of the body to an interior thereof in a second direction opposite the first direction.

In accordance with another aspect of the disclosed concept, a vacuum switching apparatus comprises: a first electrical contact; and a second electrical contact, wherein at least one of the first electrical contact and the second electrical contact comprises: a body having a center point and a periphery, the body comprising: a plurality of arcing surfaces facing in a first direction toward the other of the first electrical contact and the second electrical contact and being structured to move into and out of engagement therewith, and a plurality of arc spinning portions each defining a slot extending inwardly from the periphery generally toward the center point, the plurality of arc spinning portions generally separating the plurality of arcing surfaces from one another. At least one arc spinning portion narrows from a corresponding pair of adjacent arcing surfaces of the body to an interior thereof in a second direction opposite the first direction.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts.

As employed herein, the statement that two or more parts or components "engage" one another shall mean that the parts touch and/or exert a force against one another either directly or through one or more intermediate parts or components.

Figure 1:
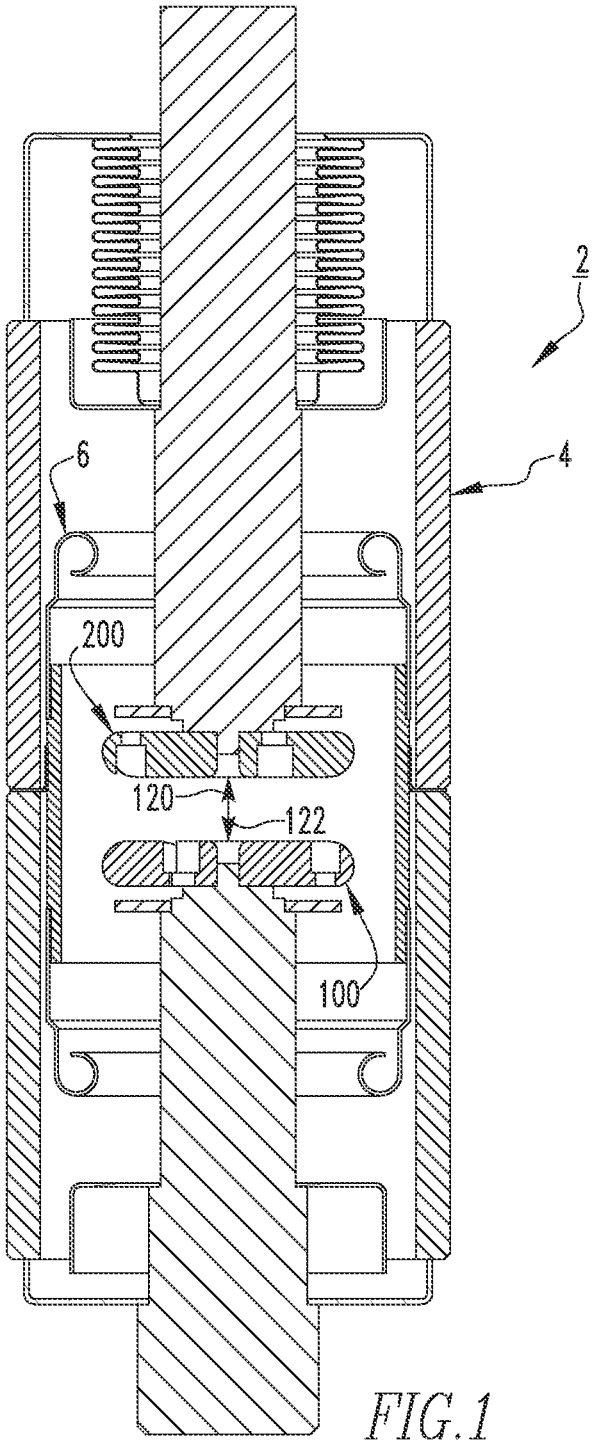
FIG. 1 is a section view of a vacuum switching apparatus and electrical contact therefor, in accordance with a non-limiting embodiment of the disclosed concept.

FIG. 1 shows a vacuum switching apparatus (e.g., vacuum interrupter 2) that includes a tubular ceramic member 4, a tubular vapor shield 6 located internal the ceramic member 4, and a pair of separable electrical contacts (e.g., spiral contacts 100,200) located internal the vapor shield 6. The spiral contacts 100,200 are structured to move into and out of engagement with each other in order to close and open the vacuum interrupter 2.

Figure 2:
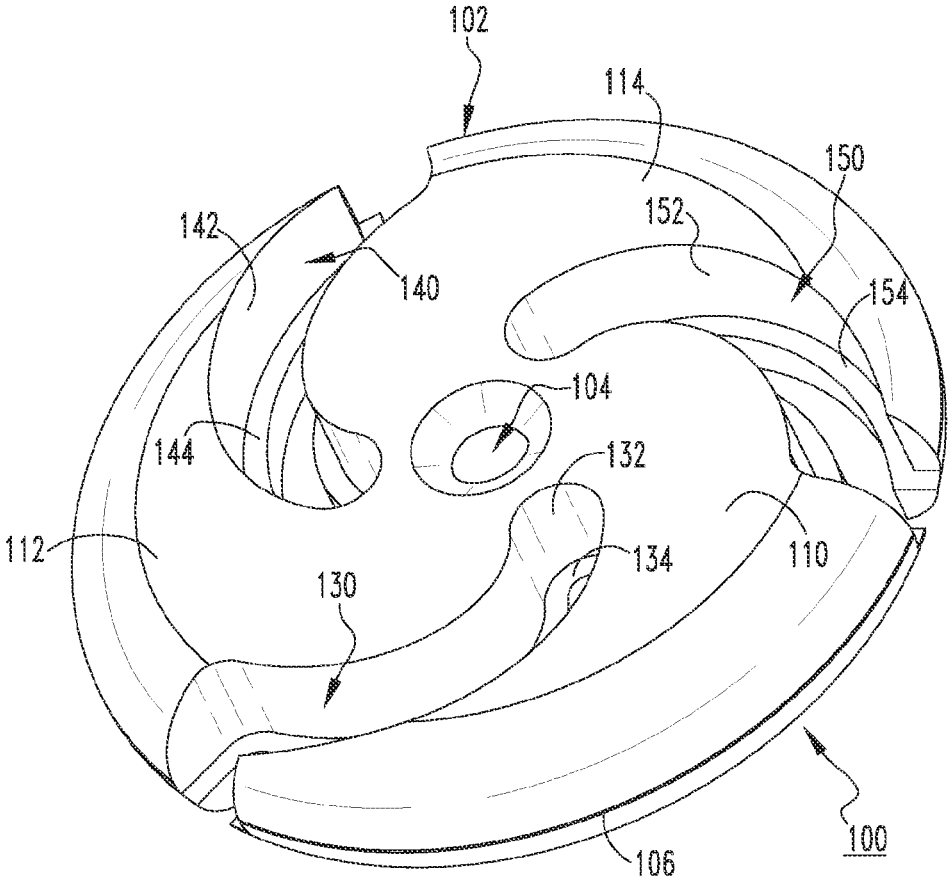
FIG. 2 is an isometric view of the electrical contact of FIG. 1.

FIG. 2 shows the first spiral contact 100, which includes a body 102 having a center point 104 and a periphery 106. The body 102 includes a plurality of arcing surfaces 110, 112,114 and a corresponding plurality of arc spinning portions 130,140,150 that generally separate the arcing surfaces 110,112,114 from one another. That is, the arc spinning portion 130 separates the arcing surface 110 from the arcing surface 112. The arc spinning portion 140 separates the arcing surface 112 from the arcing surface 114. The arc spinning portion 150 separates the arcing surface 114 from the arcing surface 110. The arcing surfaces 110,112,114 each extend from proximate the center point 104 toward the periphery 106. Furthermore, the arcing surfaces 110,112,114 each face in a first direction 120 (FIG. 1) toward the second spiral contact 200 and move into and out of engagement with the second spiral contact 200.

The arc spinning portions 130,140,150 each define a slot extending inwardly from the periphery 106 generally toward the center point 104. When the spiral contacts 100,200 move away from one another to disconnect power in the associated electrical circuit, the arc spinning portions 130,140,150 force the arc that is generated to spread across the first spiral contact 100 so that the arcing energies are not localized near the center point 104 of the spiral contact 100. In this manner, the life of the spiral contact 100 is lengthened. As will be discussed in greater detail hereinbelow, the arc spinning portions 130,140,150 narrow from the arcing surfaces 110, 112,114 of the body 102 to an interior thereof in a second direction 122 (FIG. 1) opposite the first direction 120, advantageously lengthening the time until the slots of the spiral contact 100 begin to bridge. While the respective arc spinning portions of the spiral contact 200 (FIG. 1) narrow from the respective arcing surfaces of the respective body to an interior thereof in the first direction 120, it will be appreciated that the spiral contact 200 may be substituted with any suitable alternative electrical contact without departing from the scope of the disclosed concept.

In spiral contacts (not shown) in which the slots have been bridged, extensive post-mortem analysis has found that bridging begins at the corresponding arcing surfaces and progresses toward, but never reaches, the opposite side of the contact. That is, the bridged portions (e.g., the portions across the original slots that have been partially filled with solidified molten metal of the contact material) narrow from the portion of the slots near the arcing surfaces in a direction away from the opposite electrical contact. Accordingly, by having the width of the arc spinning portions 130,140,150 be relatively wide proximate the arcing surfaces 110,112,114 and narrow from the arcing surfaces 110,112,114 of the body 102 to an interior thereof in the direction 122, the onset of bridging is advantageously prolonged, while strength is not significantly compromised.

Figure 3:
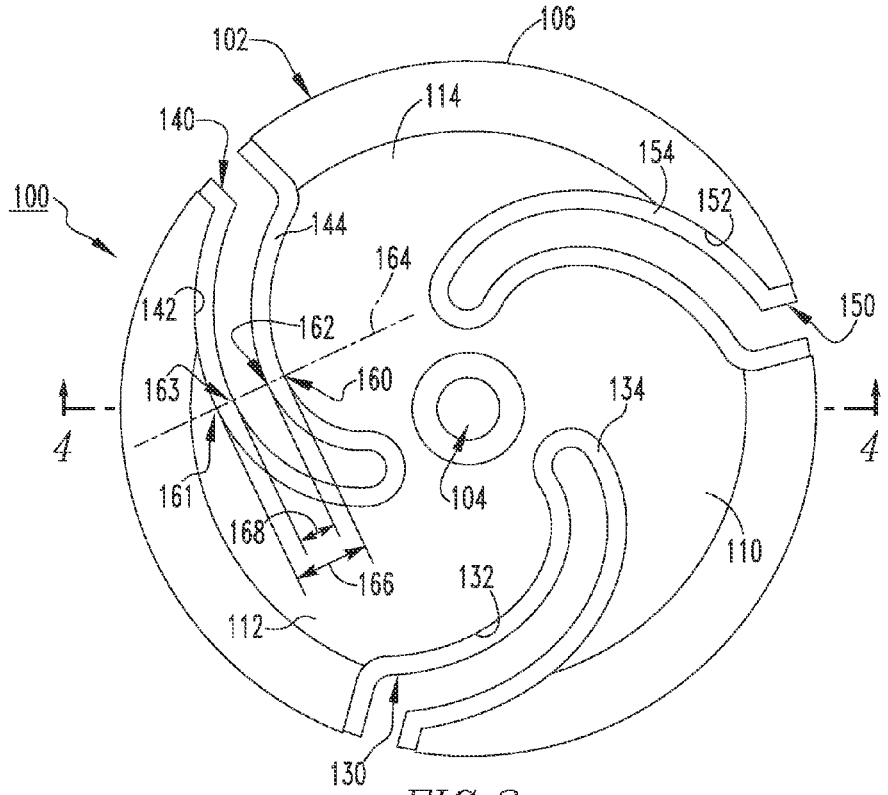
FIG. 3 is a top plan view of the electrical contact of FIG. 2.

More specifically, and with reference to FIGS. 2 and 3, the arc spinning portions 130,140,150 each include respective first interior surfaces 132,142,152 and respective second interior surfaces 134,144,154. The first interior surface 132 extends from the arcing surface 110 and the arcing surface 112 in the second direction 122 into the interior of the body 102. It will be appreciated that the first interior surfaces 142,152 likewise extend from the adjacent arcing surfaces 110,112,114 in the second direction 122 into the interior of the body 102. The respective second interior surfaces 134, 144,154 extend from the respective first interior surfaces 132,142,152 and are located generally perpendicular with respect thereto.

Figure 4:
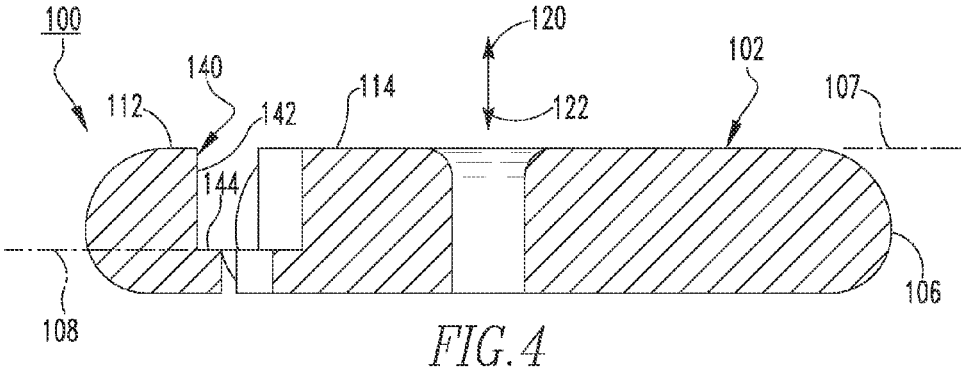
FIG. 4 is a section view of the electrical contact of FIG. 3, taken along line 4-4 of FIG. 3.

Referring to FIG. 4, which shows the cross-sectional profile of the arc spinning portion 140, the body 102 has a first plane 107 that is generally coplanar with the arcing surface 114 (i.e., and the arcing surfaces 110,112). The body 102 also has a second plane 108 spaced from and parallel to the first plane 107. The second plane 108 is located at a predetermined height in the interior of the body 102 and is generally coplanar with the second interior surface 144 (i.e., and the second interior surfaces 134,154). Thus, the second interior surfaces 134,144,154 each extend inwardly from the respective first interior surfaces 132,142,152.

Stated differently, the arc spinning portions 130,140,150 each have a first width between the respective arcing surfaces 110,112,114 and a second width in the interior of the body 102 that is less than the first width. For example, in the depicted top plan view of FIG. 3, the first plane 107 (FIG. 4) intersects the arc spinning portion 140 at a first location 160 and a second location 161 located opposite the first location 160. The second plane 108 (FIG. 4) intersects the arc spinning portion 140 at a third location 162 and a fourth location 163 located opposite the third location 162. When the body 102 is viewed from a top plan view, the locations 160,161,162,163 are each located on a longitudinal axis 164. The first location 160 is spaced a first distance (i.e., a first width 166) from the second location 161. The third location 162 is spaced a second distance (i.e., a second width 168) from the fourth location 163. The second width 168 is less than the first width 166. It will be appreciated that the respective second widths (shown but not indicated) of the arc spinning portions 130,150 are likewise less than the respective first widths (shown but not indicated) of the arc spinning portions 130,150.

After repeated interruption of relatively high fault currents, the time until bridging begins in the spiral contact 100 is advantageously lengthened, as compared to spiral contacts (not shown) with arc spinning portions that have consistent, relatively narrow widths. That is, because bridging begins between the arcing surfaces 110,112,114 and as a result of the relatively wide first widths 166 (and the first widths of the arc spinning portions 130,150), the melted portions (i.e., after repeated interruption of relatively high fault current) of the body 102 have a greater distance to bridge across. Furthermore, because the arc spinning portions 130,140,150 narrow from the arcing surfaces 110,112,114 of the body 102 to an interior thereof in the direction 122, bridging in the interior of the body 102 is not significantly affected and mechanical strength of the spiral contact 100 is not significantly compromised. More specifically, because bridging decreases from the arcing surfaces 110,112,114 in the direction 122, the relatively narrow second widths 168 (and the second widths of the arc spinning portions 130,150) do not affect the onset of bridging. Additionally, mechanical strength of the spiral contact 100 is not significantly compromised because the portions of the arc spinning portions 130,140,150 with the relatively narrow second widths 168 (and the second widths of the arc spinning portions 130,150) provide a relatively secure connection to the center of the body 102.

Figure 5:
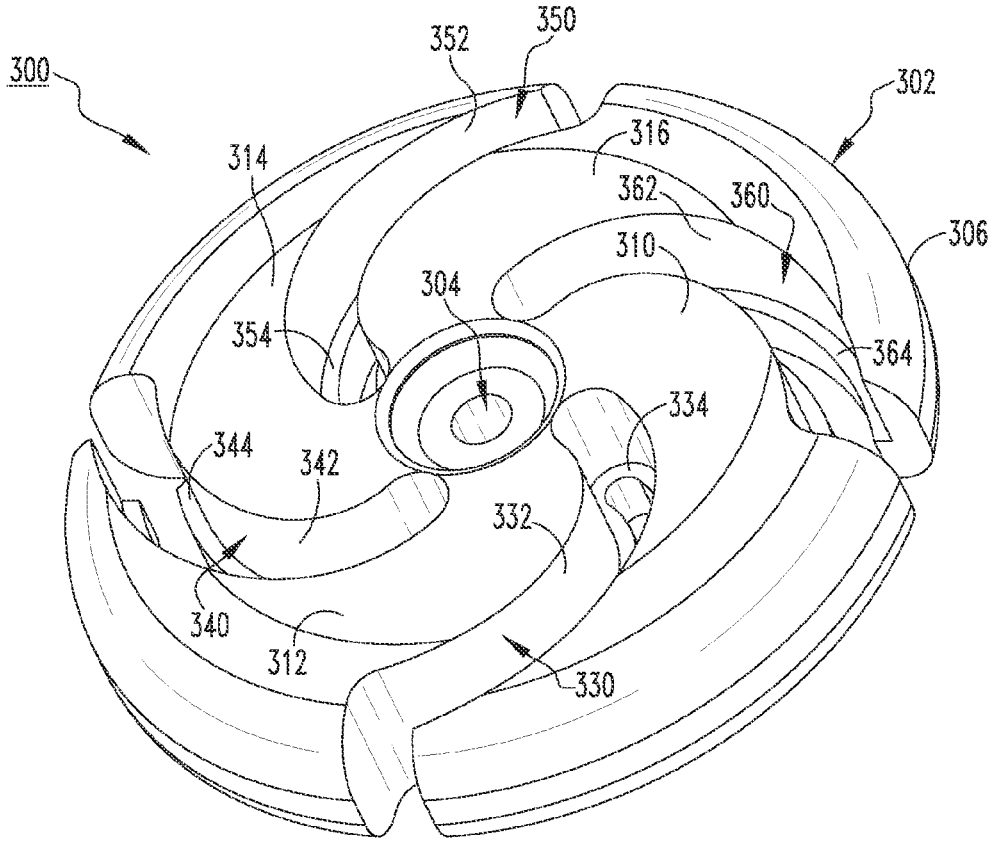
FIG. 5 is an isometric view of another electrical contact, in accordance with another non-limiting embodiment of the disclosed concept.
Figure 6:
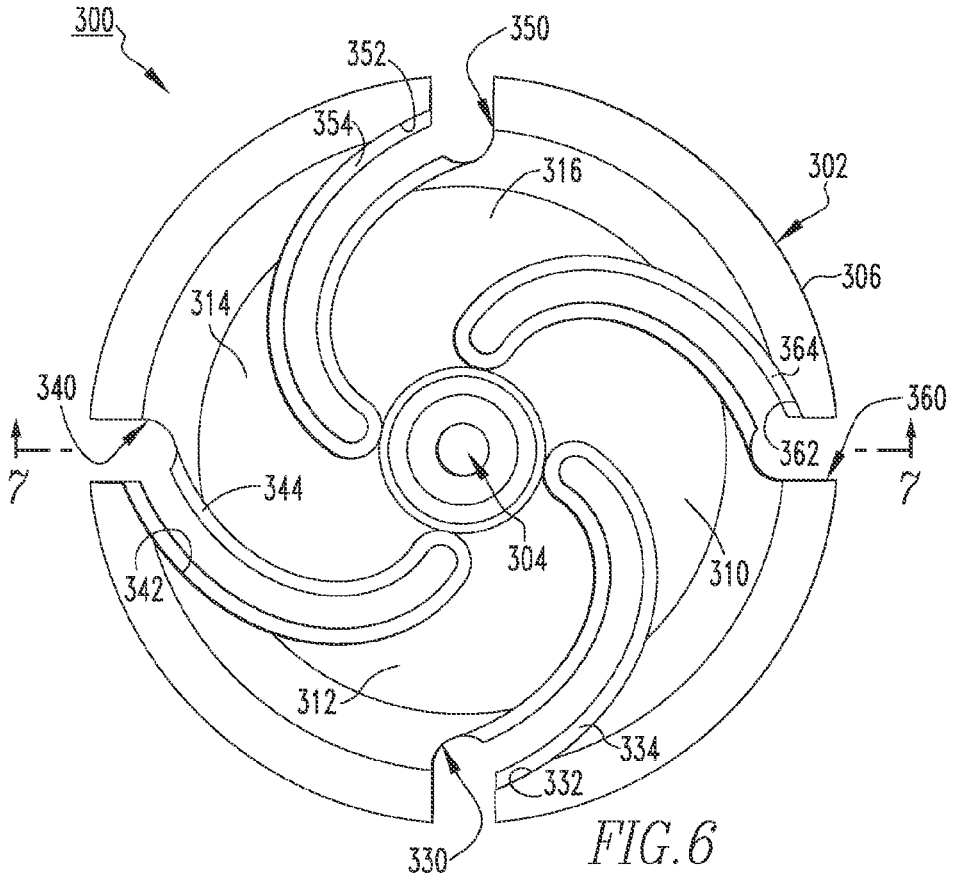
FIG. 6 is a top plan view of the electrical contact of FIG. 5.
Figure 7:
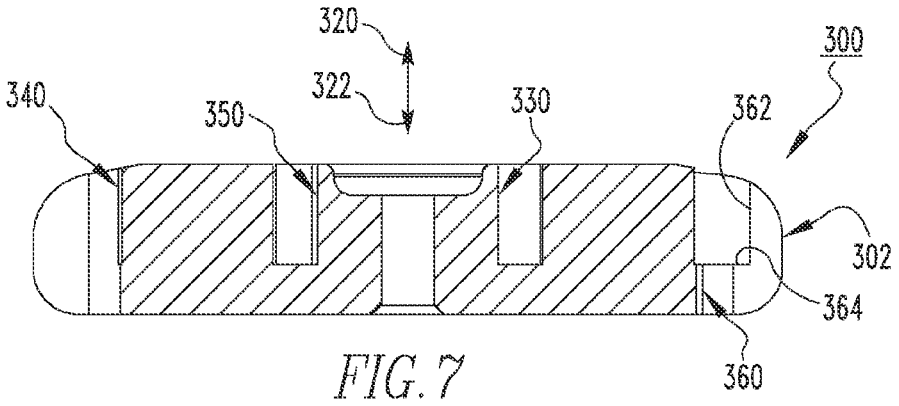
FIG. 7 is a section view of the electrical contact of FIG. 6, taken along line 7-7 of FIG. 6.

The disclosed concept applies to spiral contacts (i.e., the spiral contacts 300,400 (FIGS. 5-10)) having any suitable alternative number of arc spinning portions. For example, as seen in the non-limiting example of FIGS. 5-7, the alternative spiral contact 300, which may be substituted into the vacuum interrupter 2 (FIG. 1) in place of either of the spiral contacts 100,200, includes many of the same structural characteristics as the spiral contact 100 (FIGS. 1-4), and like components are labeled with like reference numerals. As shown, the spiral contact 300 includes an additional arc spinning portion 360 separating the arcing surface 310 from an additional arcing surface 316. The arc spinning portions 330,340,350,360 narrow from the arcing surfaces 310,312, 314,316 of the body 302 to an interior thereof in the second direction 322 (FIG. 7).

Figure 8:
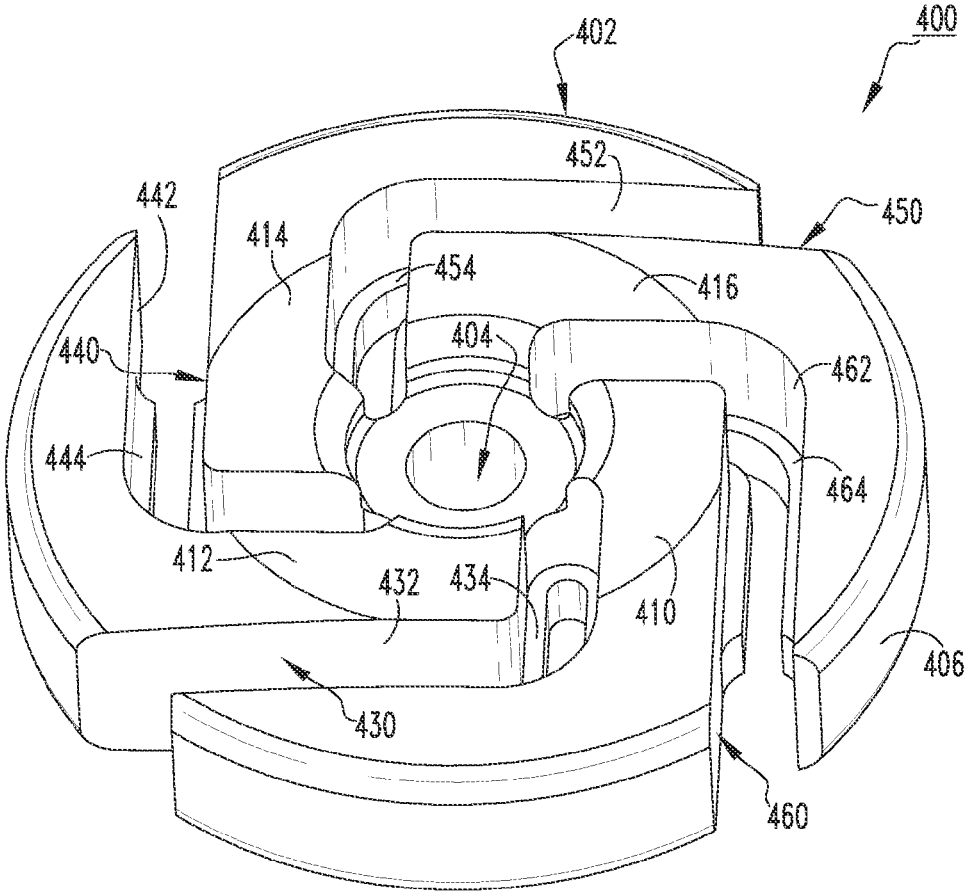
FIG. 8 is an isometric view of another electrical contact, in accordance with another non-limiting embodiment of the disclosed concept.
Figure 9:
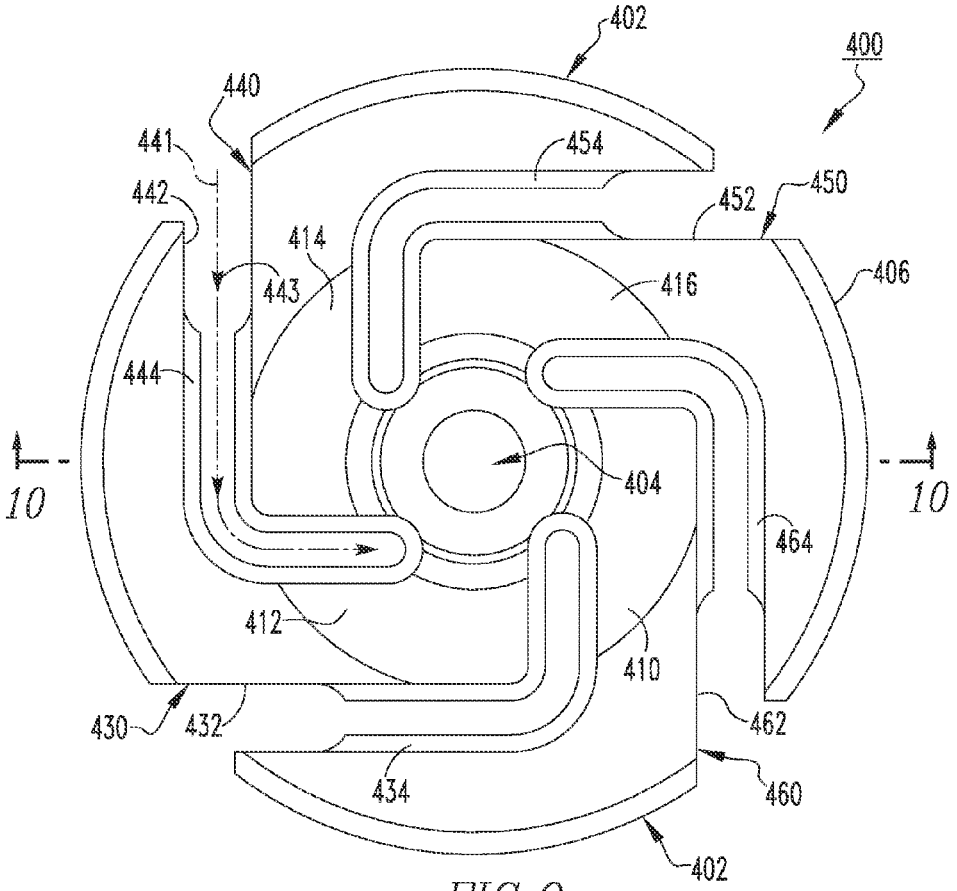
FIG. 9 is a top plan view of the electrical contact of FIG. 8.
Figure 10:
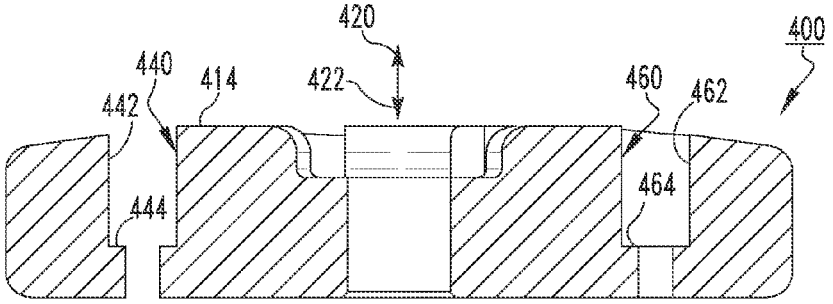
FIG. 10 is a section view of the electrical contact of FIG. 9, taken along line 10-10 of FIG. 9.

Additionally, as seen in the non-limiting example of FIGS. 8-10, the alternative spiral contact 400, which may be substituted into the vacuum interrupter 2 (FIG. 1) in place of either of the spiral contacts 100,200, includes many of the same structural characteristics as the spiral contact 100 (FIGS. 1-4), and like components are labeled with like reference numerals. The spiral contact 400, like the spiral contact 300 (FIGS. 5-7), includes an additional arc spinning portion 460 separating the arcing surface 410 from an additional arcing surface 416. The arc spinning portions 430,440,450,460 narrow from the arcing surfaces 410,412, 414,416 of the body 402 to an interior thereof in the direction 422 (FIG. 10). Moreover, the arc spinning portions 430,440,450,460 advantageously narrow from the periphery 406 generally toward the center point 404.

More specifically, and with reference to FIG. 9, the arc spinning portion 440 has a center line 441. As shown, the arc spinning portion 440 narrows from an exterior of the body 402 to an interior thereof in a direction 443 from the periphery 406 along the center line 441 toward the center point 404. It will be appreciated that the arc spinning portions 430,450,460 likewise narrow from an exterior of the body 402 to an interior thereof in respective directions along respective center lines. Continuing to refer to FIG. 9, the respective first interior surfaces 432,442,452,462 each extend generally from proximate the center point 404 to the periphery 406. However, the respective second interior surfaces 434,444,454,464 each extend from proximate the center point 404 toward the periphery 406 and terminate therebetween, advantageously widening the respective arc spinning portions 430,440,450,460 proximate the periphery 406. After repeated interruption at relatively high fault currents, the onset of bridging first occurs proximate the periphery 406. Because the width of the slot of the arc spinning portion 440 is relatively wide proximate the periphery 406 (i.e., the second interior surface 444 terminates between the center point 404 and the periphery 406), the onset of substantial bridging is thus delayed.

Figure 11:
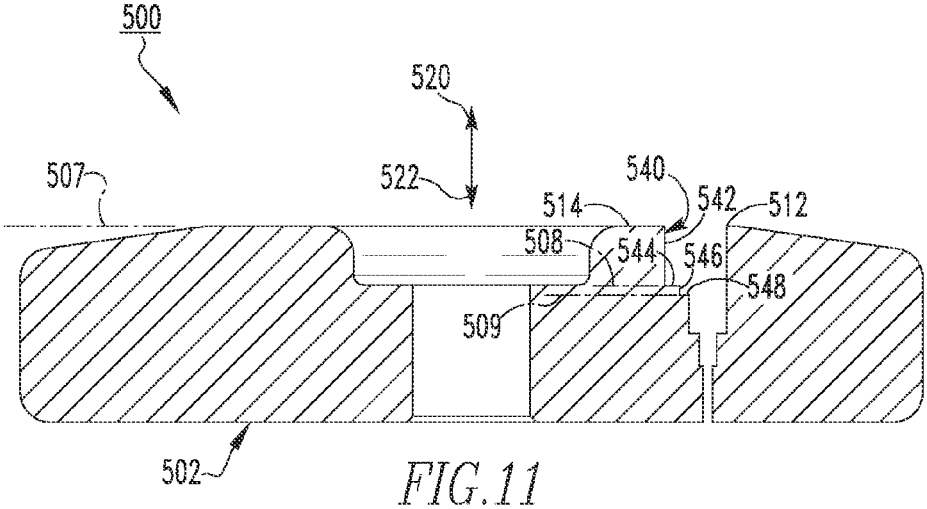
FIG. 11 is a section view of another electrical contact, in accordance with another non-limiting embodiment of the disclosed concept.

The disclosed concept is applicable to any suitable alternative spiral contact (i.e., the spiral contacts 500,600 (FIGS. 11 and 12)) having at least one arc spinning portion 540,640 narrow from corresponding adjacent arcing surfaces 512, 514,612,614 of the respective bodies 502,602 to an interior thereof in order to accomplish the desired function of lengthening the time until the onset of bridging after repeated interruption of relatively high fault currents. For example, FIG. 11 shows a cross-sectional profile of an alternative non-limiting example spiral contact 500 which may be substituted into the vacuum interrupter 2 (FIG. 1) in place of either of the spiral contacts 100,200. The spiral contact 500 includes many of the same structural characteristics as the spiral contact 100 (FIGS. 1-4), and like components are labeled with like reference numerals. However, it will be appreciated with reference to the cross-sectional profile of FIG. 11 that the arc spinning portion 540 includes a number of other interior surfaces (i.e., third interior surface 546 and fourth interior surface 548). The third interior surface 546 extends from the second interior surface 544 in the second direction 522. The fourth interior surface 548 extends from the third interior surface 546. As shown, the body 502 has a third plane 509 parallel to the first plane 507 and the second plane 508. The fourth interior surface 548 is located in the third plane 509.

Figure 12:
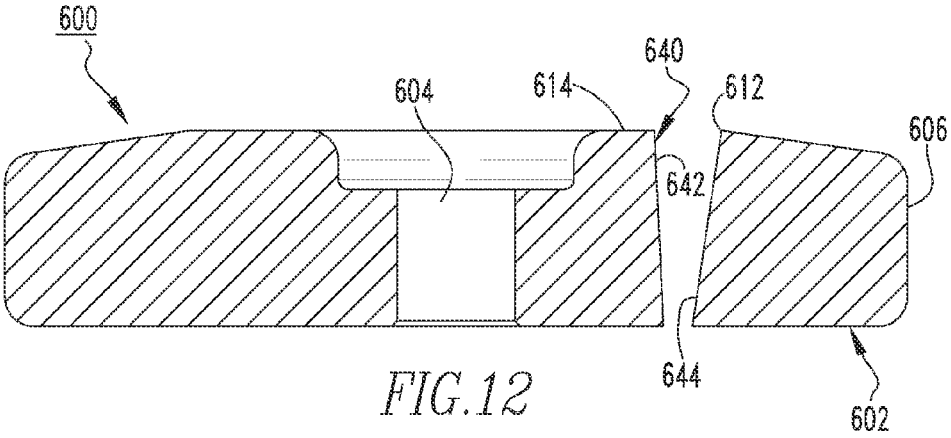
FIG. 12 is a section view of another electrical contact, in accordance with another non-limiting embodiment of the disclosed concept.

Additionally, as seen in the non-limiting example cross-sectional profile of FIG. 12, the alternative spiral contact 600, which may be substituted into the vacuum interrupter 2 (FIG. 1) in place of either of the spiral contacts 100,200, includes similar structural characteristics as the spiral contact 100 (FIGS. 1-4). Although not readily apparent in the cross-sectional profile of FIG. 12, it will be appreciated that the arc spinning portion 640 that separates the adjacent arcing surfaces 612,614, includes a first interior surface 642 and a second interior surface 644 that each extend from proximate the center point 604 toward the periphery 606 (e.g., similar to the arc spinning portions 130,140,150 discussed hereinabove). As shown, the first interior surface 642 extends from the arcing surface 614 into the interior of the body 602 toward the second interior surface 644. Similarly, the second interior surface 644 extends from the arcing surface 612 into the interior of the body 602 toward the first interior surface 642.

Accordingly, it will be appreciated that the disclosed concept provides for an improved (e.g., without limitation, longer lasting) vacuum switching apparatus 2 and electrical contact 100,200,300,400,500,600 therefor, which among other benefits, prolongs the life of the electrical contact 100,200,300,400,500,600 by narrowing an arc spinning portion 130,140,150, 330,340,350,360,430,440,450,460,540, 640 of the electrical contact 100,200,300,400,500,600 from a corresponding pair of adjacent arcing surfaces 110,112, 114,310,312,314,316,410,412, 414,416,512,514,612,614 of the electrical contact 100,200,300,400,500,600 to an interior thereof in a direction opposite an opposing electrical contact.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An electrical contact for a vacuum switching apparatus, said vacuum switching apparatus comprising a second electrical contact, said electrical contact comprising:

a body having a center point and a periphery, said body comprising:

a plurality of arcing surfaces structured to face in a first direction toward said second electrical contact and structured to move into and out of engagement with said second electrical contact, and a plurality of arc spinning portions each defining a slot extending inwardly from the periphery generally toward the center point, said plurality of arc spinning portions generally separating said plurality of arcing surfaces from one another;

wherein, at least one arc spinning portion of said plurality of arc spinning portions narrows from a corresponding pair of adjacent arcing surfaces of said body to an interior thereof in a second direction opposite the first direction; wherein said plurality of arcing surfaces comprises a first arcing surface and a second arcing surface adjacent said first arcing surface; wherein said at least one arc spinning portion generally separates said first arcing surface from said second arcing surface, wherein said at least one arc spinning portion comprises a first interior surface and a second interior surface; wherein said first interior surface extends from said first arcing surface in the second direction; wherein said second interior surface is spaced from said first arcing surface and said second arcing surface; and wherein said second interior surface extends from said first interior surface and is disposed generally perpendicular with respect thereto.

2. The electrical contact of claim 1 wherein said first interior surface further extends from said second arcing surface in the second direction.

3. The electrical contact of claim 1 wherein said at least one arc spinning portion further comprises a third interior surface and a fourth interior surface; wherein said third interior surface extends from said second interior surface in the second direction; wherein said fourth interior surface extends from said third interior surface; wherein said body has a first plane, a second plane, and a third plane each generally parallel to and spaced from one another; wherein said first arcing surface and said second arcing surface are disposed in the first plane; wherein said second interior surface is disposed in the second plane; and wherein said fourth interior surface is disposed in the third plane.

4. The electrical contact of claim 1 wherein said at least one arc spinning portion has a center line; and wherein said at least one arc spinning portion narrows from an exterior of said body to an interior thereof in a third direction from the periphery along the center line toward the center point.

5. The electrical contact of claim 1 wherein said plurality of arcing surfaces comprises a first arcing surface and a second arcing surface adjacent said first arcing surface; wherein said at least one arc spinning portion has a first width between said first arcing surface and said second arcing surface; wherein said at least one arc spinning portion has a second width in the interior of said body; and wherein the second width is less than the first width.

6. The electrical contact of claim 5 wherein said body has a first plane and a second plane generally parallel to and spaced from the first plane; wherein the first plane is generally coplanar with said first arcing surface and said second arcing surface; wherein the second plane is disposed at a predetermined height in the interior of said body; wherein the first plane intersects said at least one arc spinning portion at a first location and a second location disposed opposite the first location; wherein the second plane intersects said at least one arc spinning portion at a third location and a fourth location disposed opposite the third location; wherein, when said body is viewed from a top plan view, the first location, the second location, the third location, and the fourth location are each disposed on a longitudinal axis; wherein the first location is spaced a first distance from the second location; wherein the third location is spaced a second distance from the fourth location; and wherein the second distance is less than the first distance.

7. The electrical contact of claim 1 wherein said electrical contact is a spiral contact; wherein said plurality of arcing surfaces comprises a first arcing surface, a second arcing surface adjacent said first arcing surface, and a third arcing surface adjacent said first arcing surface and said second arcing surface; wherein each of said first arcing surface, said second arcing surface, and said third arcing surface extends from proximate the center point toward the periphery; wherein said at least one arc spinning portion comprises a first arc spinning portion, a second arc spinning portion, and a third arc spinning portion; wherein said first arc spinning portion generally separates said first arcing surface from said second arcing surface; wherein said second arc spinning portion generally separates said second arcing surface from said third arcing surface; and wherein said third arc spinning portion generally separates said third arcing surface from said first arcing surface.

8. The electrical contact of claim 1 wherein said electrical contact is a spiral contact; wherein said plurality of arcing surfaces comprises a first arcing surface, a second arcing surface adjacent said first arcing surface, a third arcing surface adjacent said second arcing surface, and a fourth arcing surface adjacent said third arcing surface and said first arcing surface; wherein each of said first arcing surface, said second arcing surface, said third arcing surface, and said fourth arcing surface extends from proximate the center point toward the periphery; wherein said at least one arc spinning portion comprises a first arc spinning portion, a second arc spinning portion, a third arc spinning portion, and a fourth arc spinning portion; wherein said first arc spinning portion generally separates said first arcing surface from said second arcing surface; wherein said second arc spinning portion generally separates said second arcing surface from said third arcing surface; wherein said third arc spinning portion generally separates said third arcing surface from said fourth arcing surface; and wherein said fourth arc spinning portion generally separates said fourth arcing surface from said first arcing surface.

9. The electrical contact of claim 4 wherein said plurality of arcing surfaces comprises a first arcing surface and a second arcing surface adjacent said first arcing surface; wherein said at least one arc spinning portion generally separates said first arcing surface from said second arcing surface; wherein said at least one arc spinning portion comprises a first interior surface and a second interior surface; wherein said first interior surface extends from said first arcing surface and said second arcing surface in the second direction; wherein said first interior surface extends generally from proximate the center point to the periphery; wherein said second interior surface is spaced from said first arcing surface and said second arcing surface; wherein said second interior surface extends from said first interior surface; and wherein said second interior surface extends generally from proximate the center point toward the periphery and terminates therebetween.

10. An electrical contact for a vacuum switching apparatus, said vacuum switching apparatus comprising a second electrical contact, said electrical contact comprising:

a body having a center point and a periphery, said body comprising:

a plurality of arcing surfaces structured to face in a first direction toward said second electrical contact and structured to move into and out of engagement with said second electrical contact, and a plurality of arc spinning portions each defining a slot extending inwardly from the periphery generally toward the center point, said plurality of arc spinning portions generally separating said plurality of arcing surfaces from one another;

wherein, at least one arc spinning portion of said plurality of arc spinning portions narrows from a corresponding pair of adjacent arcing surfaces of said body to an interior thereof in a second direction opposite the first direction; wherein said plurality of arcing surfaces comprises a first arcing surface and a second arcing surface adjacent said first arcing surface; wherein said at least one arc spinning portion generally separates said first arcing surface from said second arcing surface; wherein said at least one arc spinning portion comprises a first interior surface and a second interior surface each extending from proximate the center point toward the periphery; wherein said first interior surface extends from said first arcing surface into the interior of said body toward said second interior surface; and wherein said second interior surface extends from said second arcing surface into the interior of said body toward said first interior surface.

11. A vacuum switching apparatus comprising:

a first electrical contact; and a second electrical contact, wherein at least one of said first electrical contact and said second electrical contact comprises:

a body having a center point and a periphery, said body comprising:

a plurality of arcing surfaces facing in a first direction toward the other of said first electrical contact and said second electrical contact and being structured to move into and out of engagement therewith, and a plurality of arc spinning portions each defining a slot extending inwardly from the periphery generally toward the center point, said plurality of arc spinning portions generally separating said plurality of arcing surfaces from one another;

wherein, at least one arc spinning portion of said plurality of arc spinning portions narrows from a corresponding pair of adjacent arcing surfaces of said body to an interior thereof in a second direction opposite the first direction; wherein said vacuum switching apparatus is a vacuum interrupter; and wherein both of said first electrical contact and said second electrical contact comprise:

a body having a center point and a periphery, said body comprising:

a plurality of arcing surfaces facing in a first direction toward the other of said first electrical contact and said second electrical contact and being structured to move into and out of engagement therewith, and a plurality of arc spinning portions each defining a slot extending inwardly from the periphery generally toward the center point, said plurality of arc spinning portions generally separating said plurality of arcing surfaces from one another; and wherein, at least one arc spinning portion of said plurality of arc spinning portions of each of said first electrical contact and said second electrical contact narrows from a corresponding pair of adjacent arcing surfaces of said respective body to an interior thereof in a respective second direction opposite the respective first direction.

12. A vacuum switching apparatus comprising: p1 a first electrical contact; and a second electrical contact, wherein at least one of said first electrical contact and said second electrical contact comprises:

a body having a center point and a periphery, said body comprising:

a plurality of arcing surfaces facing in a first direction toward the other of said first electrical contact and said second electrical contact and being structured to move into and out of engagement therewith, and a plurality of arc spinning portions each defining a slot extending inwardly from the periphery generally toward the center point, said plurality of arc spinning portions generally separating said plurality of arcing surfaces from one another;

wherein, at least one arc spinning portion of said plurality of arc spinning portions narrows from a corresponding pair of adjacent arcing surfaces of said body to an interior thereof in a second direction opposite the first direction; wherein said plurality of arcing surfaces comprises a first arcing surface and a second arcing surface adjacent said first arcing surface; wherein said at least one arc spinning portion generally separates said first arcing surface from said second arcing surface; wherein said at least one arc spinning portion comprises a first interior surface and a second interior surface; wherein said first interior surface extends from said first arcing surface in the second direction; wherein said second interior surface is spaced from said first arcing surface and said second arcing surface; and wherein said second interior surface extends from said first interior surface and is disposed generally perpendicular with respect thereto.

13. The vacuum switching apparatus of claim 12 wherein said first interior surface further extends from said second arcing surface in the second direction.

14. The vacuum switching apparatus of claim 12 wherein said at least one arc spinning portion further comprises a third interior surface and a fourth interior surface; wherein said third interior surface extends from said second interior surface in the second direction; wherein said fourth interior surface extends from said third interior surface; wherein said body has a first plane, a second plane, and a third plane each generally parallel to and spaced from one another; wherein said first arcing surface and said second arcing surface are disposed in the first plane; wherein said second interior surface is disposed in the second plane; and wherein said fourth interior surface is disposed in the third plane.

15. The vacuum switching apparatus of claim 12 wherein said at least one arc spinning portion has a center line; and wherein said at least one arc spinning portion narrows from an exterior of said body to an interior thereof in a third direction from the periphery along the center line toward the center point.

16. The vacuum switching apparatus of claim 15 wherein said plurality of arcing surfaces comprises a first arcing surface and a second arcing surface adjacent said first arcing surface; wherein said at least one arc spinning portion generally separates said first arcing surface from said second arcing surface; wherein said at least one arc spinning portion comprises a first interior surface and a second interior surface; wherein said first interior surface extends from said first arcing surface and said second arcing surface in the second direction; wherein said first interior surface extends generally from proximate the center point to the periphery; wherein said second interior surface is spaced from said first arcing surface and said second arcing surface; wherein said second interior surface extends from said first interior surface; and wherein said second interior surface extends generally from proximate the center point toward the periphery and terminates therebetween.

17. The vacuum switching apparatus of claim 12 wherein said plurality of arcing surfaces comprises a first arcing surface and a second arcing surface adjacent said first arcing surface; wherein said at least one arc spinning portion has a first width between said first arcing surface and said second arcing surface; wherein said at least one arc spinning portion has a second width in the interior of said body; and wherein the second width is less than the first width.

18. The vacuum switching apparatus of claim 17 wherein said body has a first plane and a second plane generally parallel to and spaced from the first plane; wherein the first plane is generally coplanar with said first arcing surface and said second arcing surface; wherein the second plane is disposed at a predetermined height in the interior of said body; wherein the first plane intersects said at least one arc spinning portion at a first location and a second location disposed opposite the first location; wherein the second plane intersects said at least one arc spinning portion at a third location and a fourth location disposed opposite the third location; wherein, when said body is viewed from a top plan view, the first location, the second location, the third location, and the fourth location are each disposed on a longitudinal axis; wherein the first location is spaced a first distance from the second location; wherein the third location is spaced a second distance from the fourth location; and wherein the second distance is less than the first distance.

* * * * *